US007661900B2

(12) United States Patent
Merzon

(10) Patent No.: US 7,661,900 B2
(45) Date of Patent: Feb. 16, 2010

(54) BINDER

(76) Inventor: Adam Merzon, 26 Memory La., Greenwich, CT (US) 06381

( * ) Notice: Subject to any disclaimer, the term of this patent is extended or adjusted under 35 U.S.C. 154(b) by 183 days.

(21) Appl. No.: 10/816,362

(22) Filed: Mar. 31, 2004

(65) Prior Publication Data

US 2005/0226681 A1 Oct. 13, 2005

(51) Int. Cl.

| | |
|---|---|
| ***B42F 13/00*** | (2006.01) |
| ***B42F 13/20*** | (2006.01) |
| ***B42F 13/12*** | (2006.01) |
| ***B42F 3/00*** | (2006.01) |
| ***B42D 3/00*** | (2006.01) |
| ***B42D 17/00*** | (2006.01) |
| ***B42D 7/00*** | (2006.01) |
| ***B42D 1/00*** | (2006.01) |
| ***B65D 85/48*** | (2006.01) |
| ***B65D 73/00*** | (2006.01) |

(52) U.S. Cl. ..... 402/70; 402/73; 402/31; 402/80 R; 402/502; 402/500; 402/75; 281/29; 281/45; 281/15.1; 206/450; 206/472

(58) Field of Classification Search ..... 281/12, 281/13, 14, 15.1, 10, 21.1, 22, 24, 27.1, 27.2, 281/27.3, 28, 38, 42, 44, 45, 48, 49, 46, 50, 281/29, 35, 36; 402/4, 31, 32, 44, 73, 79, 402/80 L, 80 P, 80 R, 60, 71, 70, 502; 229/67.2, 229/67.3; 24/67 R; D19/32, 33; 150/128; 190/126, 900, 901, 903; 383/97; *A45C 03/02, A45C 13/10; B42C 07/00; B42D 03/00; B42F 13/00, B42F 13/26, 13/42*

See application file for complete search history.

(56) References Cited

U.S. PATENT DOCUMENTS

| | | | | | |
|---|---|---|---|---|---|
| 1,121,197 | A | * | 12/1914 | McMillan | 402/31 |
| 1,414,758 | A | * | 5/1922 | Stavenhagen | 402/60 |
| 2,233,898 | A | * | 3/1941 | Pitt et al. | 402/31 |
| 2,317,673 | A | * | 4/1943 | Craig | 434/98 |

(Continued)

FOREIGN PATENT DOCUMENTS

DE 4237287 C1 * 10/1993

(Continued)

*Primary Examiner*—Dana Ross
*Assistant Examiner*—Justin V Lewis
(74) *Attorney, Agent, or Firm*—Stephen Cannavale, Esq.

(57) ABSTRACT

A binder arrangement that has a plurality of covers hingably connected to a spine that spaces apart each cover such that each cover can carry a binder and be closed one on top of the other without either binder interfering with each other or case closure. Each binder includes a hold down page that is releasably attached by a hold down page latch that accommodates the binder holding contents having different thicknesses. In a preferred embodiment, the hold down page latch comprises a hook and loop fastener that has a loop strip fixed to a latch strap and a hook strip that is fixed to the hold down page. To increase the number of opening and closing cycles the binder arrangement can endure, the binder arrangement has sidewalls joined by a fastening arrangement that is resiliently anchored at one end to the spine, preferably by an elastomeric connector. In one preferred embodiment, the fastening arrangement is a zipper that is resiliently anchored at its zipper bottom stop by a piece of elastic fabric.

24 Claims, 9 Drawing Sheets

U.S. PATENT DOCUMENTS

| | | | | | |
|---|---|---|---|---|---|
| 2,333,523 | A | * | 11/1943 | Cohun | 281/16 |
| 3,454,694 | A | * | 7/1969 | Peace et al. | 264/151 |
| 3,837,680 | A | * | 9/1974 | Cimini | 281/16 |
| 4,470,620 | A | * | 9/1984 | Gerch | 281/31 |
| 4,515,493 | A | * | 5/1985 | Radovich | 402/4 |
| 4,575,273 | A | * | 3/1986 | Gerriet | 402/75 |
| 4,856,817 | A | * | 8/1989 | Moor | 281/29 |
| 4,943,177 | A | * | 7/1990 | Jordan et al. | 402/72 |
| 5,222,825 | A | * | 6/1993 | Wyant | 402/76 |
| 5,332,327 | A | * | 7/1994 | Gillum | 402/31 |
| D364,640 | S | * | 11/1995 | Zimbelman | D19/27 |
| 5,540,512 | A | * | 7/1996 | Pinzauti | 402/79 |
| 5,607,246 | A | * | 3/1997 | Podosek | 402/73 |
| 5,611,573 | A | * | 3/1997 | Lobel et al. | 281/29 |
| 5,620,207 | A | * | 4/1997 | Podosek et al. | 281/29 |
| 5,676,443 | A | * | 10/1997 | Derelanko | 353/120 |
| 5,711,627 | A | * | 1/1998 | Chapman | 402/3 |
| 5,785,445 | A | * | 7/1998 | Podosek et al. | 402/73 |
| 5,975,576 | A | * | 11/1999 | Vogel | 281/16 |
| 6,079,528 | A | * | 6/2000 | Moor | 190/126 |
| 6,155,602 | A | * | 12/2000 | Mylander et al. | 281/42 |
| 6,209,917 | B1 | * | 4/2001 | Welch | 281/36 |
| 6,308,988 | B1 | * | 10/2001 | Mylander et al. | 281/42 |
| 6,379,070 | B1 | * | 4/2002 | Butchma | 402/73 |
| 6,394,729 | B2 | * | 5/2002 | Welch | 412/3 |
| D467,966 | S | * | 12/2002 | Lepisto | D19/26 |
| 6,488,433 | B2 | * | 12/2002 | Wien et al. | 402/73 |
| 6,746,171 | B2 | * | 6/2004 | Welch | 402/36 |
| D512,100 | S | * | 11/2005 | Howes et al. | D19/86 |
| 2005/0207827 | A1 | * | 9/2005 | Busam et al. | 402/73 |

FOREIGN PATENT DOCUMENTS

| | | | | |
|---|---|---|---|---|
| DE | 4339929 | C1 | * | 12/1994 |
| EP | 206911 | A1 | * | 12/1986 |
| FR | 2832669 | A1 | * | 5/2003 |
| GB | 1168498 | | * | 10/1969 |

* cited by examiner

BINDER

FIELD OF THE INVENTION

The present invention relates to binders, and more specifically to one or more binders that can be part a case.

BACKGROUND OF THE INVENTION

In the past, binder arrangements consisted of a pair of covers each joined to a spine by a hinge with at least one binder, such as a three ring binder, attached to an inside surface of one of the covers. In previous binder arrangements, the hinge was a conventional hinge that is a separate component that attaches to the spine and one of the covers. Unfortunately, use of a separate hinge is not only more costly to produce, but it also increases assembly costs because it requires more assembly steps. More recently, living hinges formed by a break or weakness in a board of one-piece construction have been used to break the board up into a pair of covers and a spine. However, such a hinge only permits the cover to bend relative to the spine along a single line. Where the storage volume of the binder is at or greater than the storage capacity of the binder, closing the binder becomes more difficult. In fact, repeated closings of an overfilled binder can create a crease elsewhere in one or both binder covers. Over time, such a crease can develop into a crack that leads to premature failure of the binder cover, ultimately requiring replacement of the binder.

Binders often include a hold down cover whose function is to help hold down the contents being held by the binder to keep the contents of the binder more organized. Unfortunately, hold down pages typically are themselves not tied down or otherwise anchored, making them largely ineffective. In addition, hold down pages often warp, curl or become bent over time because of this. As a result, hold down pages are often a nuisance and many times are discarded.

Binder arrangements can be packaged in the configuration of a case that can be opened using a zipper that has one end attached to the spine. Unfortunately, over time, repeated openings and closings of the zipper can tear the end of the zipper from the spine or tear the zipper such that the zipper teeth will no longer properly engage thereby making it difficult, if not impossible, to close the case.

Finally, binder arrangements that have a pair of opposed binders often are difficult to close because the rings of one of the binders often interferes against the rings of the other one of the binders. Repeated interference can cause binder rings to bend making it difficult to open and close them. Just as bad, interference between the rings can cause creasing of one or both covers if excessive force is applied, such as what can happen out of frustration, when closing the binder arrangement.

What is needed is an improved binder arrangement that can be configured as a case that addresses at least one of these problems. What is further needed is a binder arrangement that opens and closes more smoothly, that is more robust, and that lasts longer.

SUMMARY OF THE INVENTION

The invention is directed to a binder arrangement that can be configured as a case. The binder arrangement has a pair of covers connected to a spine by hinges. The inner surface of one or both covers can be equipped with a binder that has a plurality of rings capable of opening to receive sheets of material and closing to retain the sheets of material.

In one preferred embodiment, the binder arrangement includes a board or panel of one piece, unitary and homogenous construction from which the covers and spine are formed. The board or panel includes a plurality of hinges each of which is located between one of the covers and the spine. Each hinge preferably is formed of a plurality of pairs of scores formed in a surface of the board that preferably is an interior surface. Each score preferably is a slit that extends from adjacent one edge of the board to adjacent the other edge of the board. Each score is a depression formed in a surface of the board that does not extend completely through the board but which weakens the board along the score permitting the board to bend at least somewhat along each score. Collectively, the group of scores form a hinge that need not bend in an abrupt manner like prior art binder hinges, but rather which bends a little bit along a plurality of scores to impart a radius of curvature to the bend.

In a preferred embodiment, each hinge is formed by a region of scores that also compresses the board in that region and between the scores. In a preferred embodiment, the scored region is formed from between five and twelve scores that are equidistantly spaced apart. Preferably, the scored region has a width of between one half inch and one and one half inches thereby permitting the hinge to more smoothly bend. By providing a wider hinge, the storage volume of the binder is advantageously increased by as much as 40% because the hinge can bend in a plurality of places to accommodate larger storage volumes. In addition, where the binder arrangement has multiple binders, each hinge can better accommodate binder ring clashing because each hinge has more give.

In a preferred embodiment, the binder arrangement is equipped with a pair of generally opposed binders that are offset such that one of the binders does not directly overlies the other one of the binders during closing thereby preventing binder ring clashing. In one preferred embodiment, one binder is offset relative to the other binder such that the one binder is spaced farther away from a centerline of the spine than the other binder.

Each binder can be equipped with a hold down sheet that has an adjustable latch arrangement that is self-adjusting to accommodate varying binder storage volumes. The latch arrangement includes a latch strap that preferably is of flexible construction that engages with a latch receiver. One of the latch strap and latch receiver has a hook strip of a hook and loop fastener arrangement and the other one of the latch strap and latch receiver has a loop strip of a hook and loop fastener arrangement. The latch strap preferably is anchored to one of the binder covers and the latch receiver preferably comprises either a hook strip or a loop strip that is fixed directly to the hold down page.

In one preferred embodiment, the binder arrangement is configured as a case that has sidewalls extending about the outer edges of the binder covers that are releasably joined by a fastening arrangement that permits skirts of the sidewalls to be separated to enable the binder arrangement to be opened or closed. The fastening arrangement preferably is attached to the spine by a stretchable gather that preferably is of elastomeric construction. The case preferably is formed of an outer covering that is fixed to the binder covers and spine that terminates in sidewall skirts that extend outwardly beyond the peripheral edges of the binder covers. A preferred fastening arrangement is a zipper that has one end anchored to the spine by gather such that the gather stretches as needed when the zipper is being opened or closed to reduce tension at the zipper end.

Objects, features and advantages of the invention include a binder arrangement equipped with hinges having a width and contour that permits bending to take place simultaneously at a plurality of locations thereby better accommodating binder ring clash and providing increased binder storage capacity; a binder arrangement that includes binder covers, hinges and a spine formed of a board of economical one-piece, unitary and homogenous construction; a binder arrangement that has hinges which permit bending at a plurality of pairs of locations along the hinge thereby producing a bend having a smooth radius instead of an abrupt transition; a binder arrangement with hinges that make opening and closing easier under a wide variety of binder loading conditions; a binder arrangement having a plurality of generally opposed binders that prevents, if not eliminates, binder ring clashing by offsetting one of the binders relative to the other one of the binders; a binder arrangement that is configured as a case that has a zipper end mounted to the binder arrangement by a resilient and elastomeric shock absorbing arrangement that stretches as needed to take up, transfer and absorb stresses transmitted through the zipper during case opening and closing; a binder arrangement equipped with a hold down page latch arrangement that is positively locking and that is adjustable; and a binder arrangement that is of economical construction, that is robust, that is reliable, that is long-lasting, that is more durable, that is of simple construction, and which is economical to make and use.

BRIEF DESCRIPTION OF THE DRAWINGS

The drawings illustrate the best mode currently contemplated of practicing the present invention.

In the drawings.

DETAILED DESCRIPTION

Figure 1:
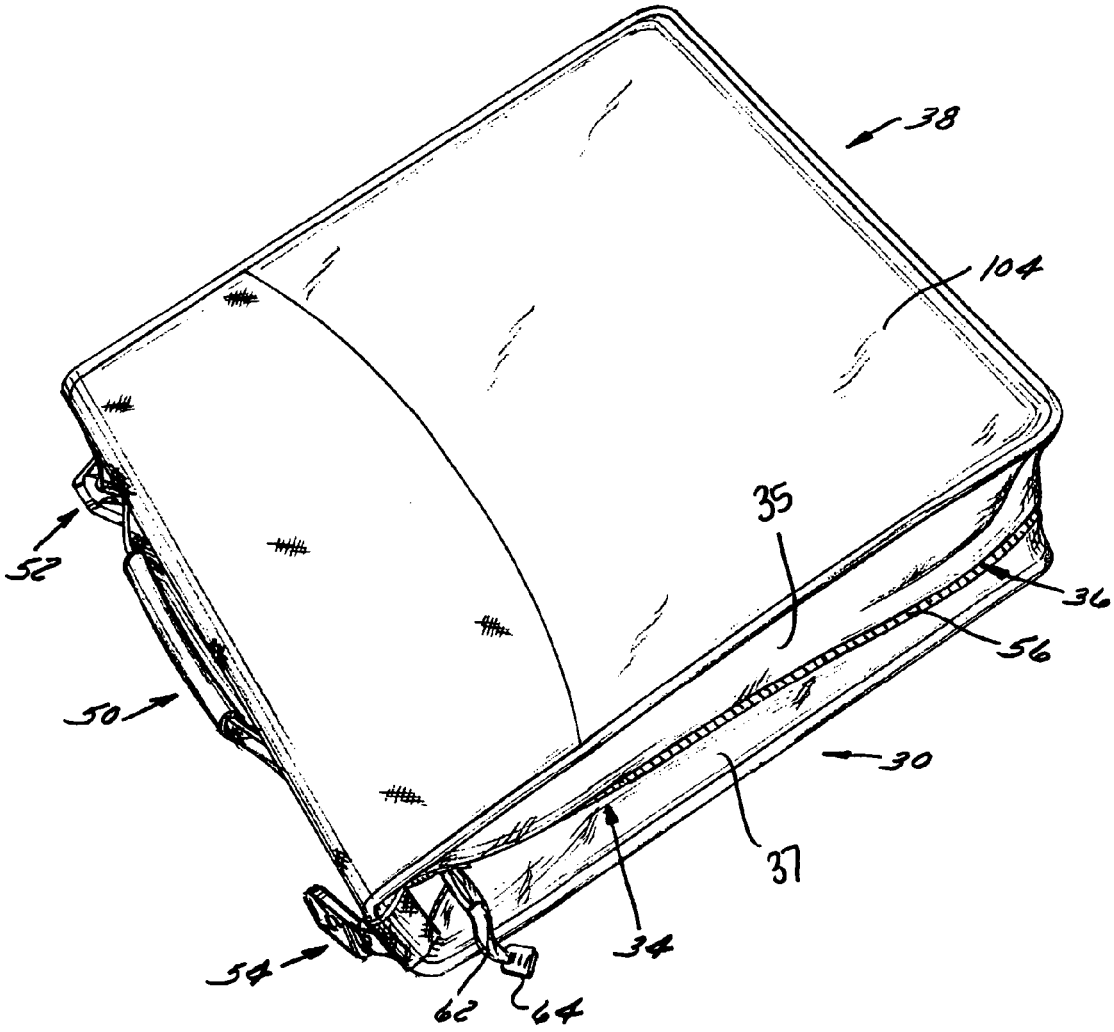
FIG. 1 is a perspective view of a binder arrangement constructed according to the present invention.
Figure 2:
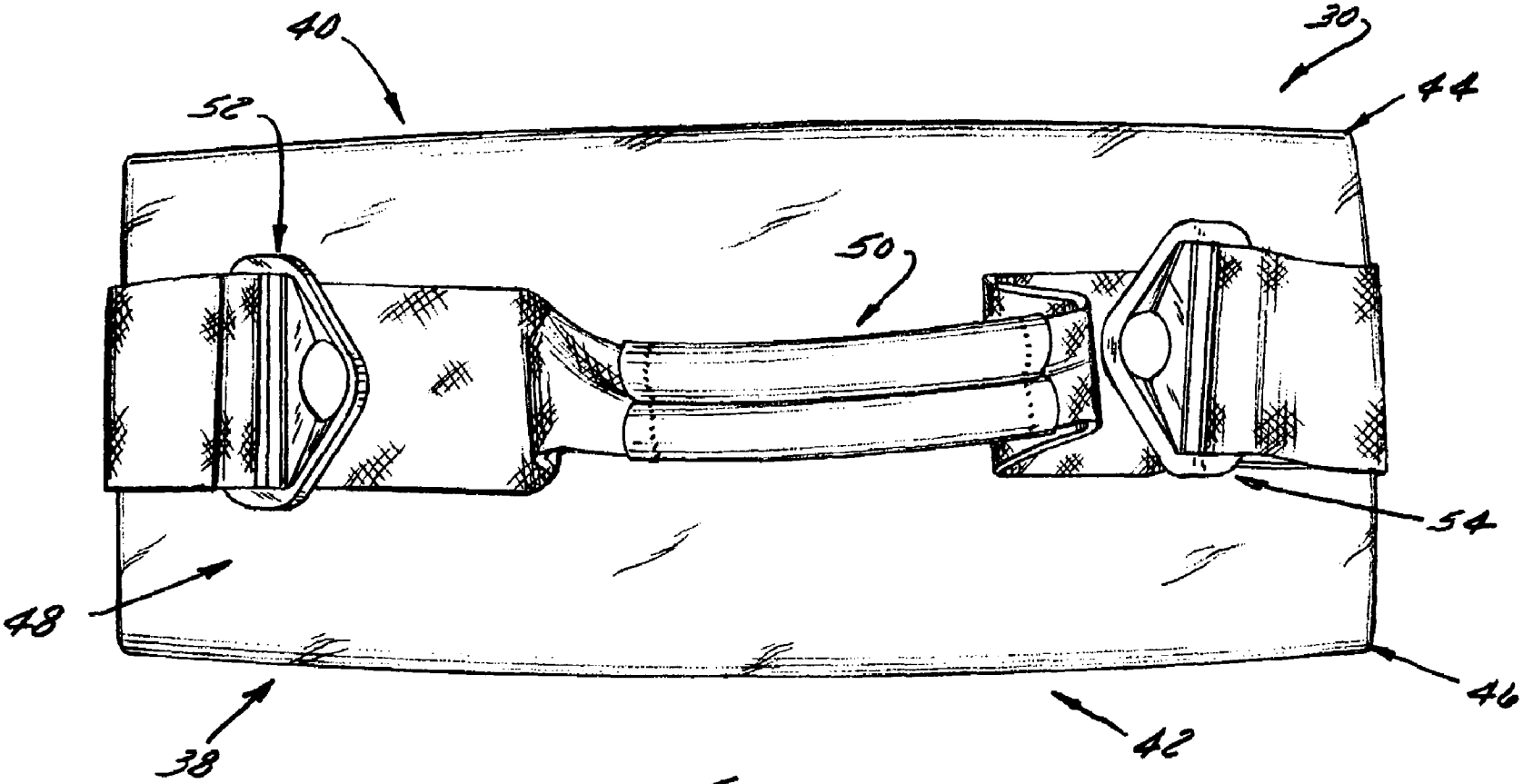
FIG. 2 is an end plan view of the binder arrangement of FIG. 1 in a closed position.
Figure 3:
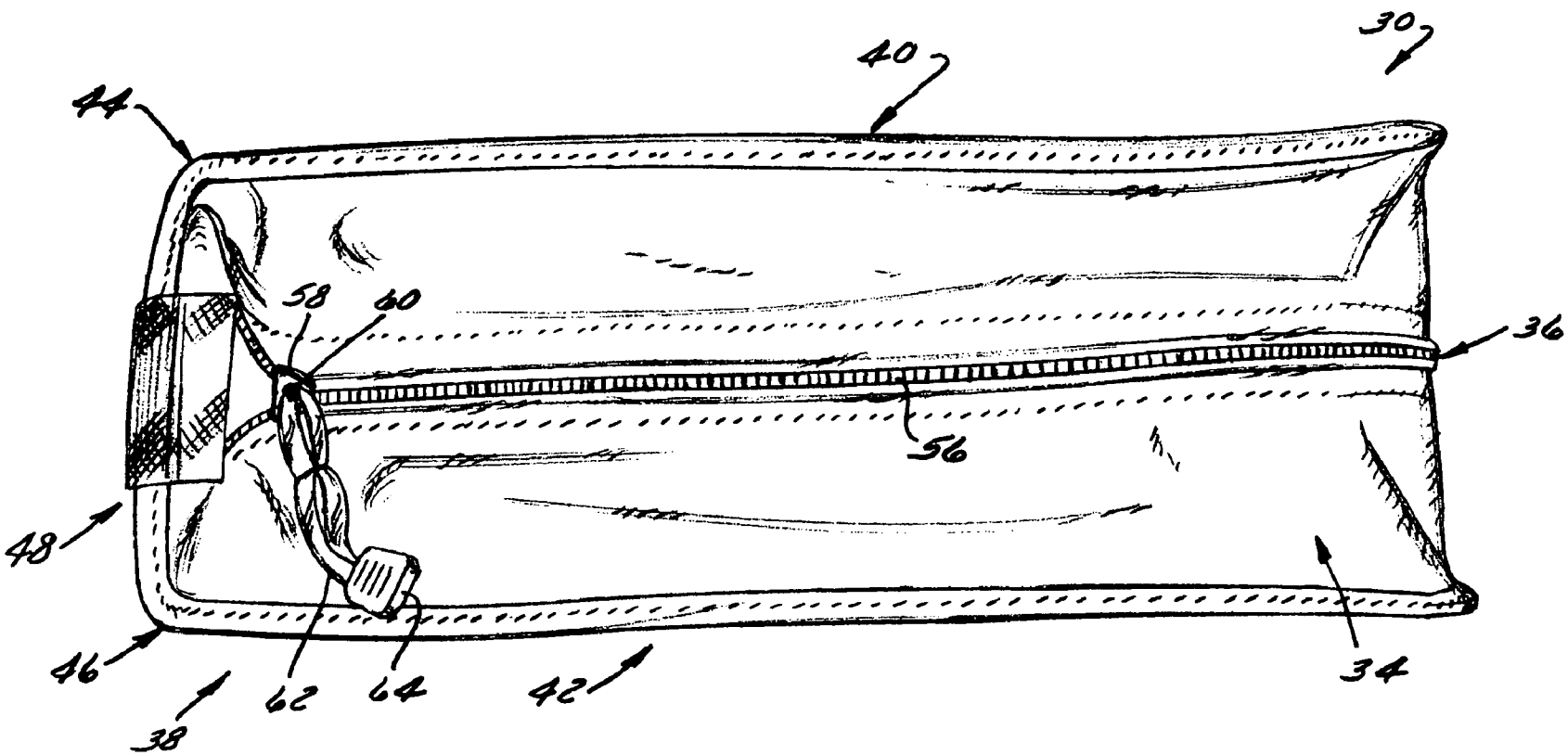
FIG. 3 is a top plan view of the binder arrangement of FIG. 1 in a closed position.

FIGS. 1-4 illustrate a preferred embodiment of a binder arrangement 30 of the invention that preferably includes at least one binder 32 (FIG. 4) and flexible fabric sidewalls 34 that retain the binder arrangement 30 in a closed position via a fastening arrangement 36. When disposed in the closed position with the fastening arrangement engaged, such as is shown in FIGS. 1-3, the binder arrangement 30 preferably forms a case 38 that houses and protects the binder contents.

The binder arrangement 30 has a front cover 40 that overlies a rear cover 42 with the front and rear covers each respectively joined by a hinge 44, 46 to a spine 48 that carries a handle 50 and a pair of strap attachment loops 52, 54. As is shown in FIG. 3, each sidewall 34 is interrupted by and releasably joined together by a fastening arrangement 36 that preferably is a zipper 56 dividing the sidewall 34 into an upper skirt 35 and lower skirt 37. To facilitate opening and closing, a slide 58 of the zipper 56 has a zipper pull tab 60 to which a lanyard 62 is attached. The lanyard 62 preferably includes a handle 64 at its free end that a user can conveniently grasp.

Figure 4:
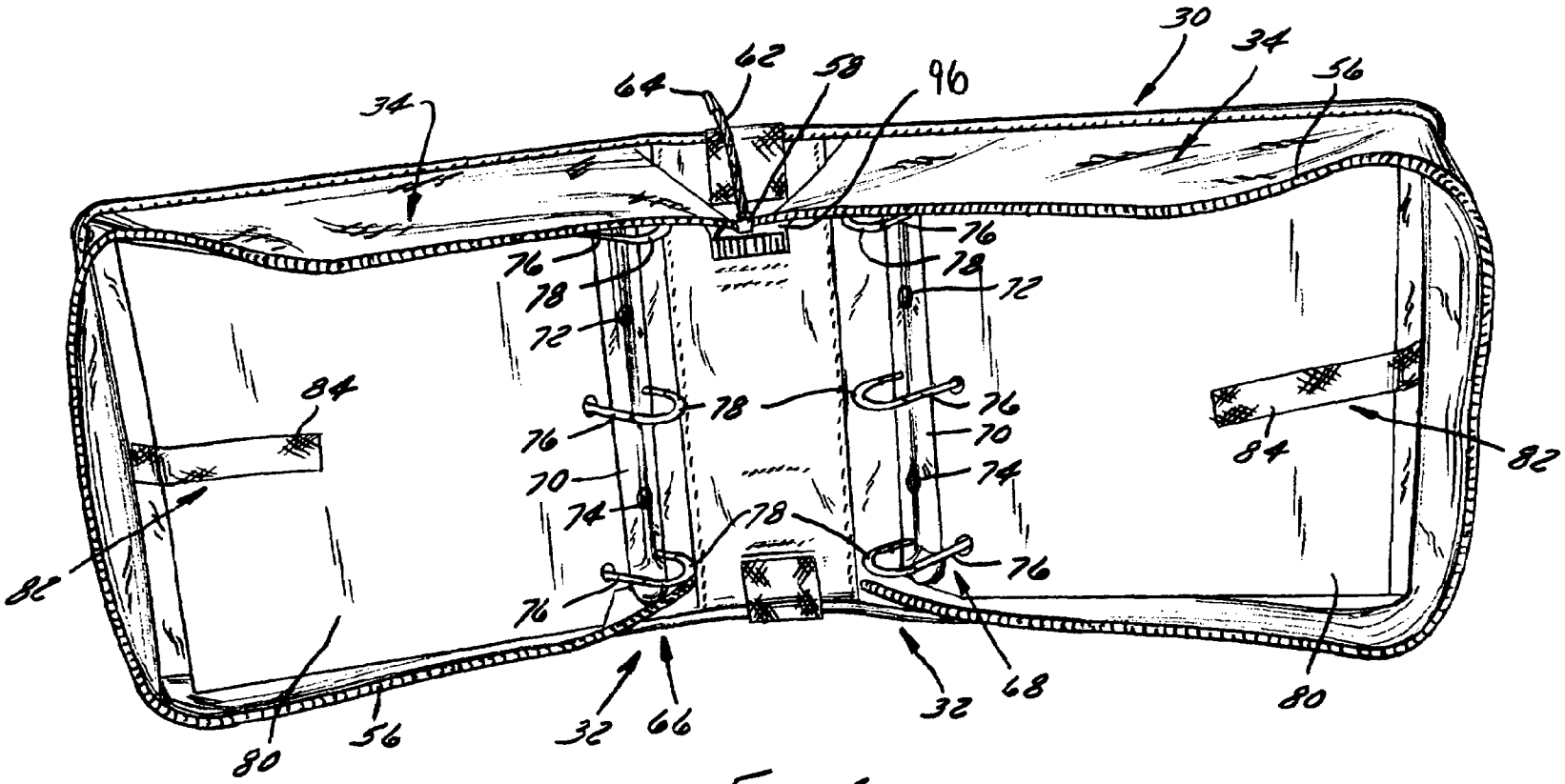
FIG. 4 is a perspective view of the binder arrangement of FIG. 1 in an open position.

FIG. 4 shows the case 38 in an opened position. As is shown in FIG. 4, the case 38 has a plurality of opposed binders, each of which preferably is a three ring binder 66 and 68. Each binder 32 has a mounting post 70 that is attached to one of the covers by a plurality of spaced apart fasteners 72, 74, each of which preferably is a rivet. Each binder 66 and 68 has a plurality of pairs of separable ring halves 76, 78 used to releasably retain pages of material. The binders 66 and 68 are spaced apart by the spine 48, the width of which preferably is selected to permit the case 38 to be closed without the binders 66 and 68 interfering with case closure or each other.

Figure 6:
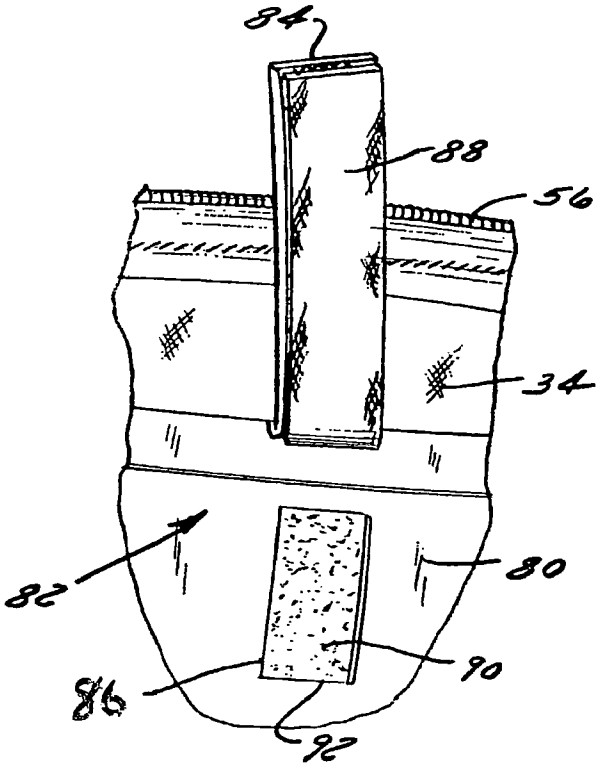
FIG. 6 is a fragmentary top plan view of the hold down page unlatched.
Figure 5:
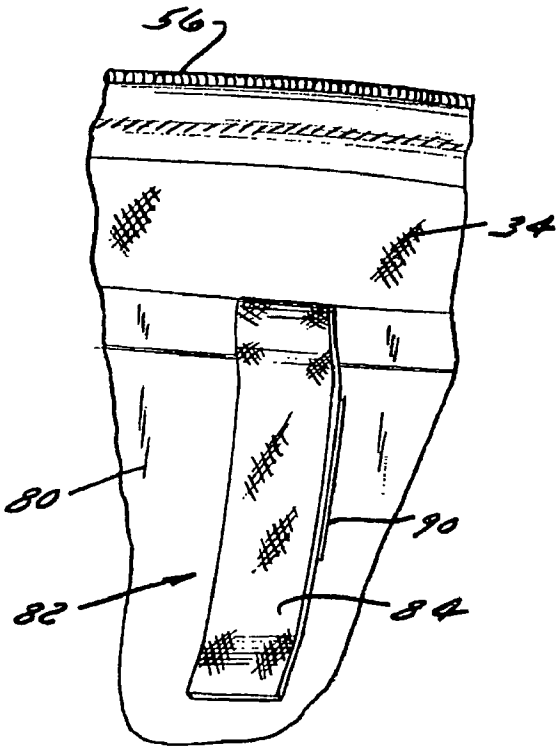
FIG. 5 is a fragmentary top plan view of a portion of the opened binder arrangement showing a hold down page in a latched condition.

As is shown in more detail in FIGS. 5 and 6, each binder 66 and 68 has a hold down page 80 that is used to keep binder contents in place while the case 38 is in use and in transit. Each hold down page 80 is releasably latched in a closed position in FIGS. 4 and 5 by an adjustable latch 82 that includes an anchor strap 84 that is anchored to part of the case 38 and a latch receiver 86 that is attached to the hold down page 80.

In the preferred embodiment shown in the drawing figures, the strap 84 and latch receiver 86 are comprised of a hook and loop fastener arrangement. As is shown in more detail in FIG. 5 with the latch 82 disposed in an unlatched position, the strap 84 is a fabric strap to which a loop strip 88 is attached, and the latch receiver 86 is a hook strip 90 that is attached to the hold down page 80. While a hook and loop fastener tape that is adhesively applied can be used, the loop strip 88 preferably is fixed, such as by stitching or the like, to the latch strap 84, and the hook strip 90 preferably is fixed, such as by stitching or the like, to the hold down page 80.

The length of each strip 88 and 90 is selected so as to ensure positive engagement therebetween for a wide variety of binder thicknesses. For example, in one preferred embodiment, the loop strip 88 extends at least one inch beyond an end 92 of the hook strip 90 and preferably extends as much as two inches beyond the hook strip end 92 when the associated binder is empty. Additionally, the loop strip 88 is at least one and one-half times the length of the hook strip 90 to help ensure maximum engagement between the two strips 88 and 90.

Figure 7:
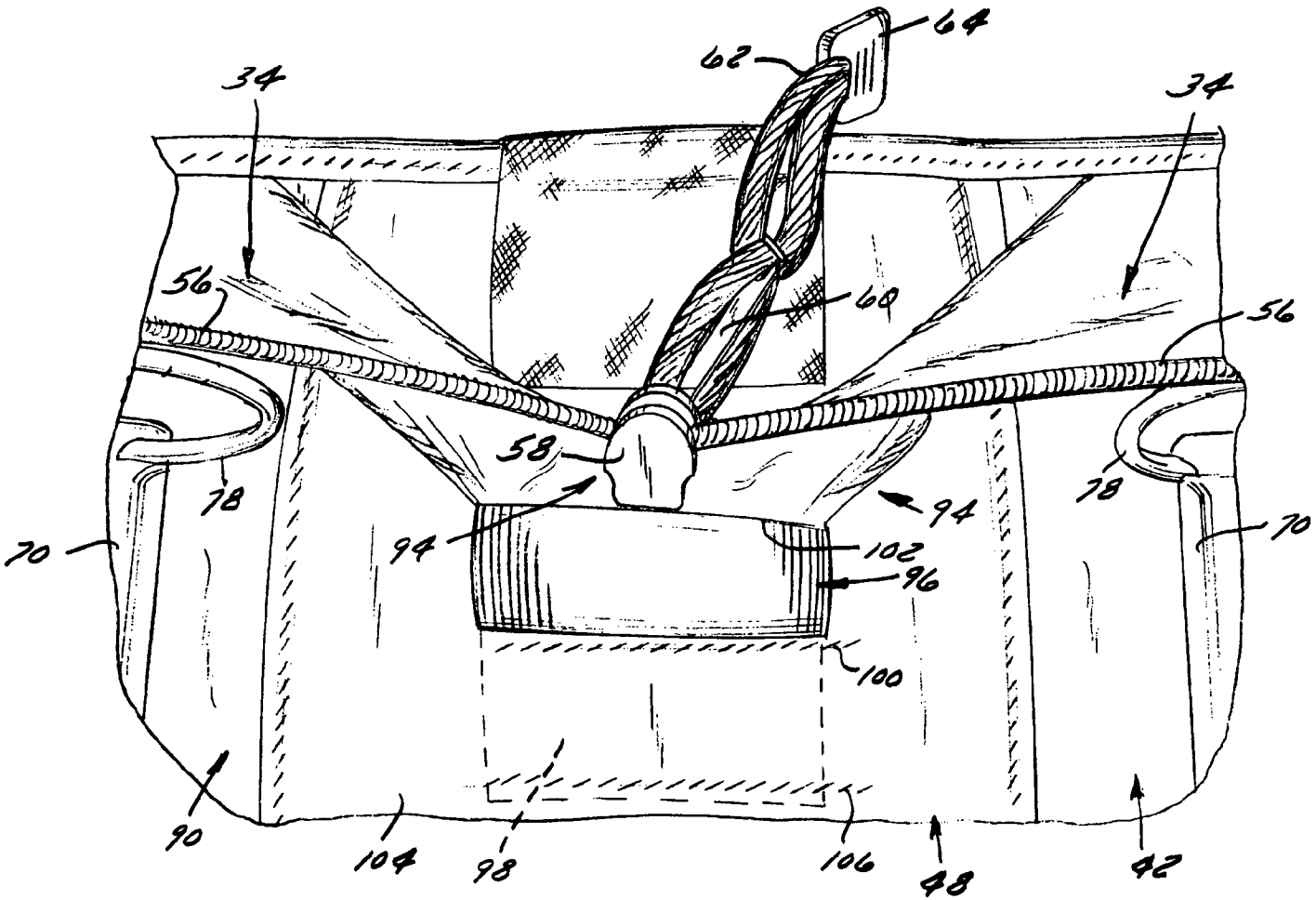
FIG. 7 is a fragmentary top plan view of a portion of the opened case illustrating zipper anchor gather or gusset.
Figure 9:
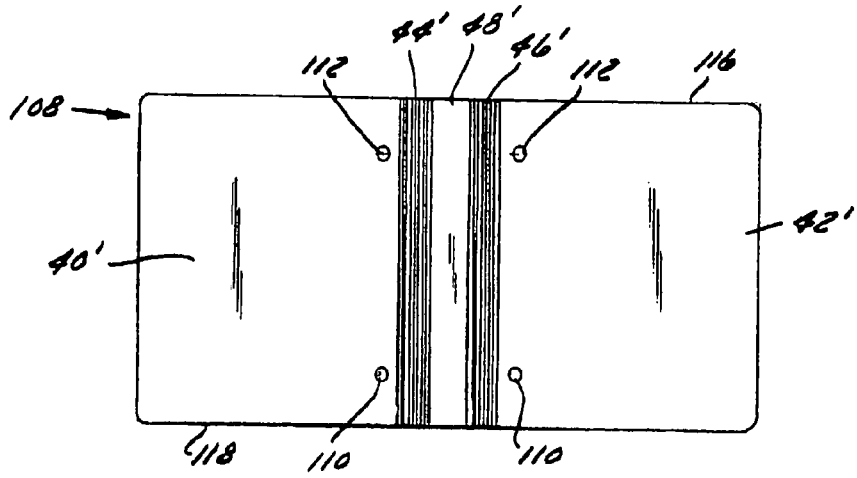
FIG. 9 is a top plan view of the panel with the covers shown in an open position.
Figure 8:
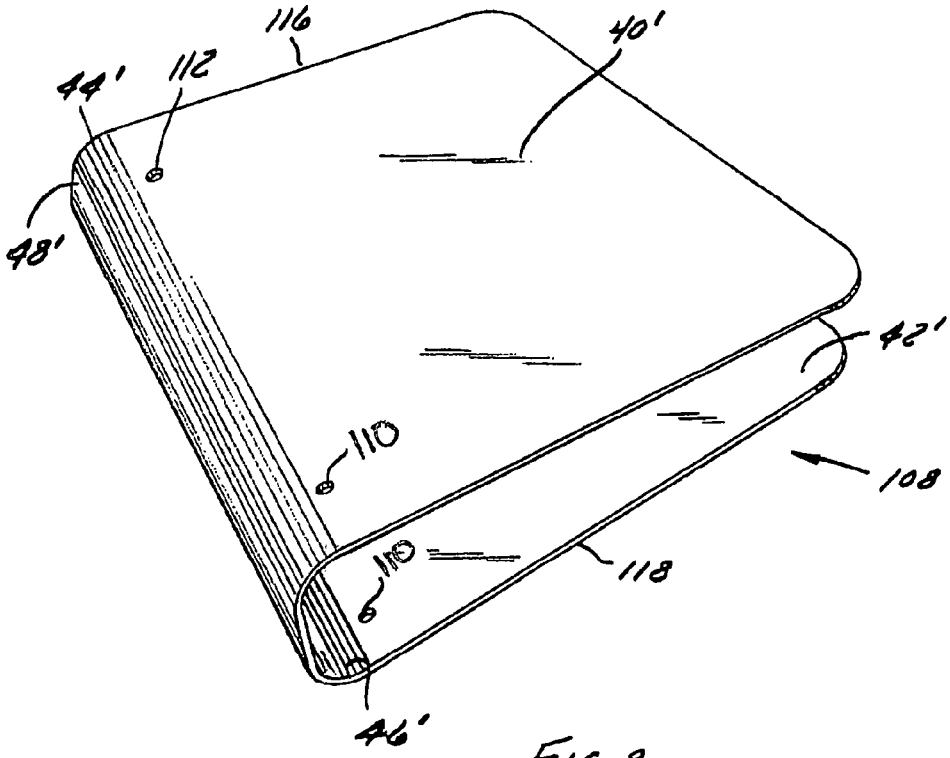
FIG. 8 is a perspective view of a panel that forms the skeleton or base of the binder arrangement that includes a pair of covers each separated from a spine by a hinge that defines a radiused bend and which is capable of bending along a plurality of pairs of locations.
Figure 10:
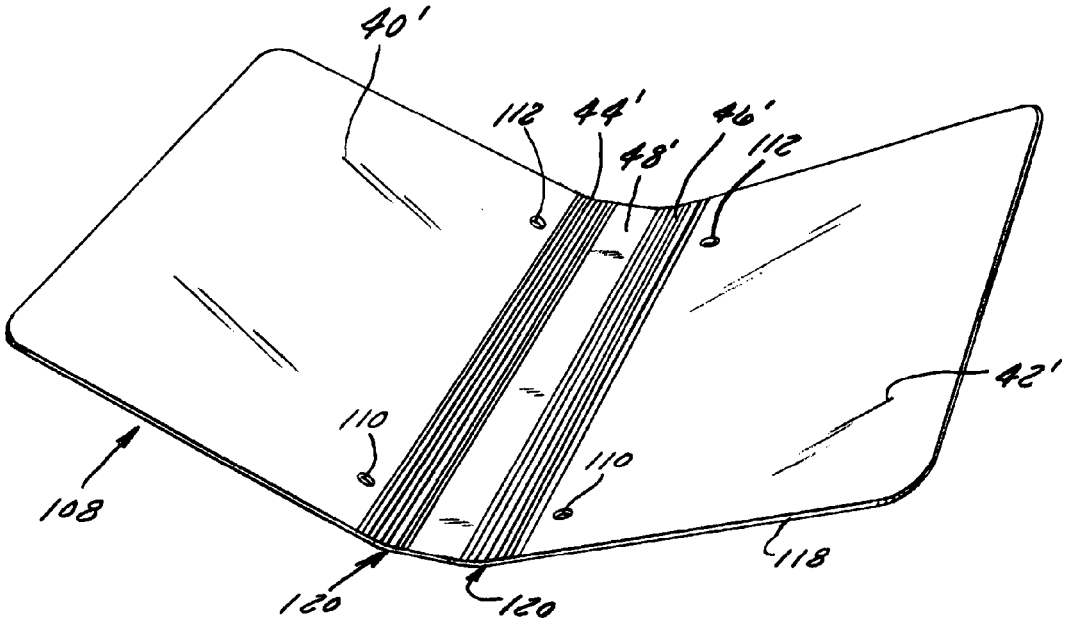
FIG. 10 is a perspective view of the panel with the covers shown in an open position depicting the shape memory imparted to the panel after formation of the hinges.

FIG. 7 illustrates a bottom stop region 94 of the zipper 56 movably anchored to the spine 48 by an elastomeric gather 96 that preferably is made of an elastic band material or of an elastic rubber. A portion 98 of the elastomeric gather 96 adjacent one end of the gather 96 is fixed, preferably via stitching 100, to the spine 48, and the other end 102 of the gather 96 is fixed preferably via stitching (not shown) to fabric in the bottom stop region of the zipper 56. In the preferred embodiment shown in FIG. 7, the anchored portion 98 of the gather 96 underlies an outer covering 104 of the case 38 and is fixed to the spine 48 using a first stitch line 100 and a second stitch line 106 that is spaced from the first stitch line 100.

The stretchable gather 96 flexes to enable the binder arrangement 30, when configured in case form, to be more conveniently used in an open position. In addition, the gather 96 stretches at least slightly to help accommodate opening of the case 38, while preventing the stress and strain of repeated openings and closings from tearing the zipper bottom stop region 94 from the spine 48. As such, the gather 96 acts as a shock absorber to accommodate repeated case openings and closings without tearing free of the spine 48 and without damaging or tearing any portion of the zipper 56.

FIGS. 8-13 illustrate a preferred embodiment of a board 108 used to form an integral binder front cover 40', binder rear cover 42', spine 48' and hinges 44' and 46' that is of one-piece, unitary and homogenous construction. In a preferred embodiment, the board 108 is constructed of a fibrous material, such as, preferably kraftboard or the like. Each cover 40' and 42' has a plurality of spaced apart binder anchors 110 and 112, each of which preferably is a perforation or bore that extends completely through its respective cover.

Figure 11:
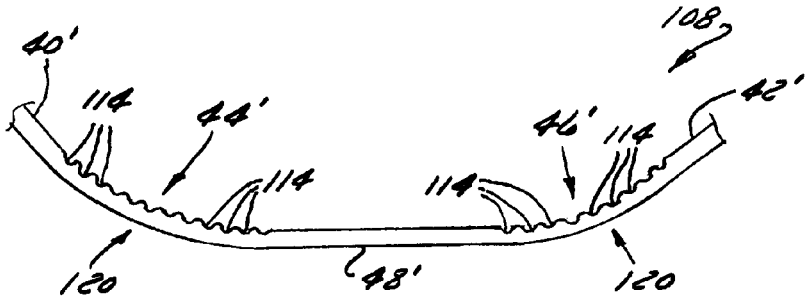
FIG. 11 is an enlarged fragmentary end view of the panel illustrating in more detail each hinge being constructed of a plurality of pairs of scores in an interior surface of the panel.
Figure 12:
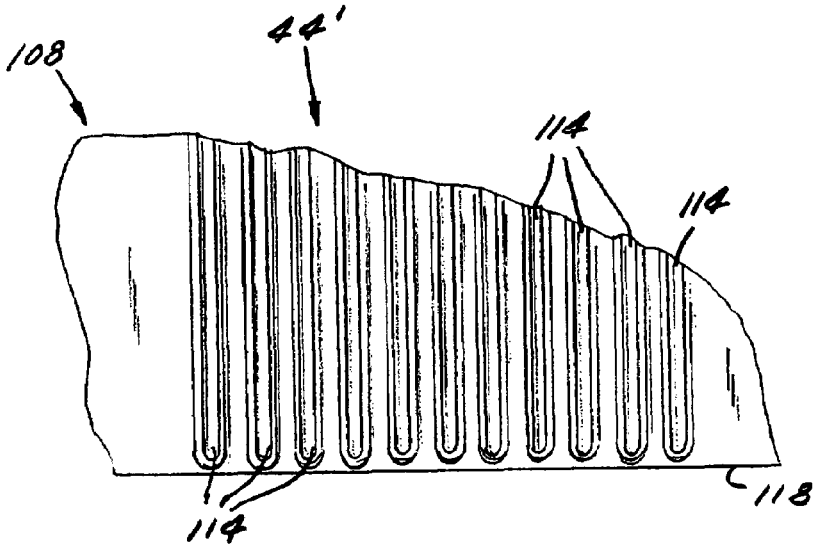
FIG. 12 is an enlarged fragmentary top plan view of another preferred hinge embodiment that is formed by scores that are slits pressed into the surface of the panel.

As is shown in more detail in FIGS. 11 and 12, each hinge 44' and 46' is integrally formed of a plurality of pairs of scores 114 (i.e., at least three) that each extend from adjacent a top side edge 116 of the board 108 to a bottom side edge 118 of the board 108. While each score 114 can be a divot, like that shown in FIG. 11, each score 114 preferably is a slit, like that shown in FIG. 12, that extends to a depth that is greater than one-quarter the thickness of the board 108 and no greater than about one-half the thickness of the board 108. The scores 114 preferably are equidistantly spaced apart. Preferably, the region of each hinge 44' and 46' is scored such that the scored region compresses the material of the board 108 at least one-sixty fourth of an inch such that a shape memory is imparted to each hinge that inherently forms a bend 120 in the board 108 at each hinge. The result is a hinge 44' and 46' that not only permits the front cover 40 and rear cover 42 to bend easily but which also helps form the board 108 into the shape of a binder.

In one preferred embodiment, each hinge 44' and 46' consists of between five and twelve scores 114 and forms a hinge that extends from between one-half inch and one and one-half inches. In a preferred embodiment, each hinge 44' and 46' has at least five scores 114 and an extent of between three quarter of an inch and one and one-quarter inch.

Figure 13:
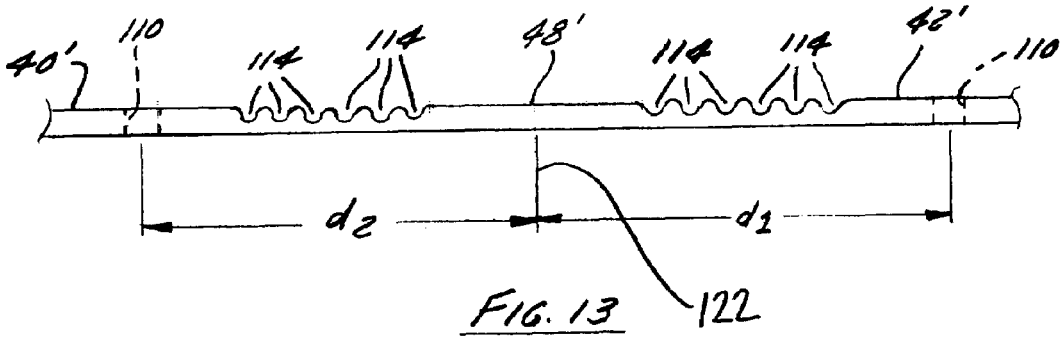
FIG. 13 is an enlarged fragmentary end view of the panel depicting offsetting of binder anchors punched in the panel so as to offset the binder attached to one cover relative to the binder attached to the other cover such that binder ring clashing preferably is prevented.

FIG. 13 illustrates another preferred aspect of the invention where the binder anchors 110 and 112 of one cover 42' are spaced farther away from a centerline 122 of the spine 48' than the binder anchors 110 and 112 of the other cover 40'. In the preferred embodiment shown in FIG. 13, the distance, $d_1$, between anchors 110 and 112 of cover 42' is greater than the distance, $d_2$, between anchors 110 and 112 of cover 40'. In one preferred embodiment, $d_1$ is between one-quarter inch and three-quarters of an inch greater than $d_2$ such that one binder 66 is offset relative to the other binder 68 a like amount. In one preferred embodiment, the offset is about one-half inch such that the difference between $d_1$ and $d_2$ is about one-half inch. As a result of this offset, where the binder arrangement 30 is a dual opposed binder arrangement, the binders 66 and 68 do not directly overlie one another when the binder arrangement 30 is closed. Such an offset advantageously facilitates closing the binder arrangement 30 without the binders 66 and 68 interfering with each other or closure of the binder arrangement.

In use, a binder arrangement 30 of the invention is well suited for holding articles that include paper, media, photos, as well as other things. In a preferred embodiment, such as that shown in drawing FIGS. 1-7, the binder arrangement 30 is configured as a case 38 that preferably includes flexible sidewalls 34 releasably joined by a fastening arrangement 36. If desired, the binder arrangement 30 can be configured so it is not a case such that it lacks sidewalls 34 and fastening arrangement 36.

In operation, where the binder arrangement 30 is configured as a case 38, the case 38 can be closed such as in the manner shown in FIGS. 1-3. When the case 38 is disposed in a closed position, the case 38 can be grasped by its handle 50 and conveniently carried like a suitcase. If desired, a detachable shoulder strap (not shown) can be attached to the strap loops 52 and 54, enabling the case 38 to be carried like a shoulder bag or the like.

Referring to FIG. 3, the case 38 can be opened by grasping the zipper lanyard 62 and pulling the zipper slide 58 in a direction away from one end of the spine 48 of the binder arrangement 30. To fully open the case 38, the zipper slide 58 is pulled in a direction that causes each pair of opposed zipper teeth of the zipper 56 to disengage. The zipper slide 58 is pulled in this manner about the periphery of the case 38 until it stops adjacent the other end of the spine 48.

The case 38 is opened by grasping both covers 40 and 42 and pulling one away from the other until both covers 40 and 42 and the spine 48 are aligned in the manner depicted in FIG. 4. When the case 38 is nearly completely open, the sidewalls 34 of the case 38 that lie along the side of the case 38 where the zipper slide 58 resides become taught, thereby creating tension at the joint created where the zipper teeth meet in the zipper bottom stop region 94. This tension is at least partially dissipated or relieved by the stretchable gather 96 used to anchor the zipper bottom stop region 94 to the spine 48. As a result, the tension actually present where the zipper teeth meet in the zipper bottom stop region 94 is greatly reduced because at least a portion of it is transferred to and absorbed by the gather 96. By the gather 96 providing stress or tension relief in this manner, tearing in the zipper bottom stop region 94 is prevented, which thereby also prevents zipper failure. In addition, by using a stretchable gather 96 to attach the zipper bottom stop region 94 to the spine 48, it functions as a shock absorber that prevents the zipper bottom stop region 94 from tearing free of the spine 48.

To access the contents of one of the binders 66 or 68, the hold down page 80 of that binder is unlatched and the hold down page 80 is pulled upwardly so it rotates on the ring halves 76 and 78 toward the spine 48. To unlatch the hold down page 80, the latch strap 84 is grasped and pulled away from the hold down page 80 until the loop strip 88 disengages from the hook strip 90. When fully disengaged, the hold down page 80 can be manipulated in the manner previously discussed to expose and permit access to the binder contents underneath.

Where the binder arrangement has two or more binders, such as binder arrangement 30 that is equipped with binders 66 and 68, any pair of binders 66 and 68 that would overlie one another when the binder arrangement is closed is offset such that the binders 66 and 68 do not directly overlie one another when the binder arrangement 30 is closed.

To help compensate for any loss of binder storage volume that may occur because of the offset, the binder arrangement 30 preferably is equipped with hinges 44 and 46 of the type depicted in FIGS. 8-13. By equipping the binder arrangement 30 with at least one such hinge and preferably a pair of such hinges, binder storage volume is increased because the relatively wide width of each hinge 44 and 46 permits the hinge to change where it bends. As a result, its bending point automatically changes to accommodate whatever the binder storage volume is. As a result, a binder arrangement 30 equipped with a pair of such hinges 44 and 46 of the invention can accommodate as much as 40% greater binder storage volume than a binder arrangement equipped with conventional hinges.

In a preferred method of manufacture, a press is used that is equipped with a die that includes a base in which the board 108 is located and held. The die includes an upper half that has ridged scorers that are pressed against the board 108 to form the scores 114 that define each one of the hinges 44 and 46. The upper half of the die preferably also is equipped with punches that form each binder anchor 110 and 112 simultaneously with the scores 114.

In a preferred embodiment, the binder arrangement 30 includes an integral case 38 that is equipped with a covering that can be, for example, ballistic nylon or the like. To help increase durability, the covering overlies both sides of each cover 40 and 42 and the spine 48. The covering preferably is attached to a board 108, such as by stitching, an adhesive, fasteners, or a combination thereof. A band is attached to the spine 48 and carries the handle 50 and both strap loops 52 and 54 while preferably reinforcing the spine 48. The band preferably is attached to the spine 48 using stitching, an adhesive, fasteners or the like.

Each binder 66 and 68 includes a hold down page 80 that is equipped with a hold down page latch 82 made in accordance with the latch 82 shown in FIGS. 4-6. The case 38 also includes a fastening arrangement 36 that is anchored at one end using a stretchable gather 96, such as the gather 96 shown in FIGS. 4 and 7. Additionally, each opposed pair of binders 66 and 68 are staggered or offset, preferably between one-fourth inch and three-quarters of an inch, to promote ease of closing of the binder arrangement 30. The binder arrangement 30 is formed from a board 108 that includes scored hinges 44 and 46 of the type depicted in FIGS. 8-13.

Various alternatives are contemplated as being within the scope of the following claims particularly pointing out and distinctly claiming the subject matter regarded as the invention.

I hereby claim:

1. A binder arrangement comprising: a) a pair of covers, and a single spine, each of said covers pivotable about said single spine into an opposed orientation each hingably carried a predetermined distance from a centerline of a spine each of said pair of covers constructed with a pivoting surface that pivots 90 degrees against each of said hinge and wherein said centerline is located at the midpoint between a first and second side edge;

b) a first set of binders permanently fixed at a location parallel and adjacent to said spine and carried by one of the covers; and c) a second binder carried by the other one of the covers, wherein both of said first set of binders and said second set of binders is located closer to said centerline than to either of said first or second side edge, d) wherein said pair of covers and spine are defined by a board that includes a pair of spaced apart integrally formed hinges with each hinge being comprised of a plurality of pairs of scores formed in an interior surface of said board, e) wherein each score comprises a slit formed in the interior surface of said board that does not extend completely through said board, and f) wherein said scores of each hinge define a region of said board that is compressed to a thickness that is less than the surrounding thickness of said board.

2. The binder arrangement of claim 1 wherein one of the binders is offset from the other one of the binders such that the binders do not overlie each other when the binder arrangement is disposed in a closed position with one of the covers generally overlying the other one of the covers.

3. The binder arrangement of claim 2 wherein one of said binders is offset relative to the other one of the binders such that one of said binders is spaced farther away from a centerline of said spine than the other one of said binders.

4. The binder arrangement of claim 3 wherein the offset is between one-quarter of an inch and three-quarters of an inch.

5. The binder arrangement of claim 4 wherein the offset is about one-half of an inch.

6. The binder arrangement of claim 1 wherein at least one of said binders has a hold down page that is equipped with a releasable latch that releasably anchors the hold down page to one of said covers.

7. The binder arrangement of claim 6 wherein said latch comprises a latch strap that is carried by one of the covers and the hold down page and a latch receiver that is carried by the other one of said covers and said hold down page.

8. The binder arrangement of claim 7 wherein one of said latch strap and latch receiver comprises a loop strip of a hook and loop fastener and the other one of said latch strap and latch receiver comprises a hook strip of a hook and loop fastener.

9. The binder arrangement of claim 8 wherein said latch strap comprises a strip of fabric to which one of said loop strip and hook strip is fixed and said latch receiver comprises the other one of said loop strip and hook strip fixed to said hold down page.

10. The binder arrangement of claim 1 further comprising a case that encompasses the binder arrangement that includes flexible sidewalls that each comprise a skirt that extends along the side edges of each cover with one said skirt releasably attached to the other said skirts by a fastening arrangement that is elastically anchored to said spine by a stretchable gather.

11. The binder arrangement of claim 10 wherein said case houses the binder arrangement, said fastening arrangement comprises a zipper, and said stretchable gather is attached at or adjacent one end to a bottom stop region of said zipper, and said stretchable gather is attached at or adjacent its other end to said spine.

12. The binder arrangement of claim 11 wherein said stretchable gather is comprised of an elastomeric material that functions as a shock absorber during opening and closing of said zipper.

13. The binder arrangement of claim 1 wherein said board is comprised of a fibrous material.

14. The binder arrangement of claim 13 wherein said board is comprised of kraftboard.

15. The binder arrangement of claim 1 wherein each hinge is defined by between five and twelve scores.

16. The binder arrangement of claim 1 wherein said board is a panel of one-piece, unitary and homogenous construction.

17. A binder arrangement comprising: a) a board of one-piece, unitary and homogenous construction that has a pair of hinges each defined by a plurality of pairs of scores formed in a surface of the board, wherein said scores of each hinge define a region of said board that is compressed to a thickness that is less than the surrounding thickness of said board with one of said hinges distinguishing said board into a first cover and a single spine and the other one of said hinges distinguishing said board into a second cover and said spine, wherein said scores are formed distinctively from said spine, each of said first and second cover hingably carried a predetermined distance from a centerline of said spine and pivotable about said single spine into an opposed orientation;

b) a first binder permanently attached to one of the covers and extending parallel to said pair of hinges;

c) a second binder permanently attached to the other one of said covers and extending parallel to said pair of hinges; and d) wherein one of the binders is spaced farther away from a centerline of said spine than the other one of said binders and wherein said centerline is located at the midpoint between a first and second side edge and wherein both of said first set of binders and said second set of binders is located closer to said centerline than to either of said first or second side edge.

18. A binder arrangement comprising:

a) a pair of covers each connected to a single spine by each of said pair of covers pivotable about said single spine into an opposed orientation and hingably carried a predetermined distance from a centerline of said spine, wherein said centerline is located at the midpoint between a first and second side edge, a pair of hinges each defined by a plurality of pairs of scores formed in a surface of the board, wherein said scores of each hinge define a region of said board that is compressed to a thickness that is less than the surrounding thickness of said board wherein said pair of covers has a planar surface extending parallel to said hinge, each of said covers being provided on a plane and including an open position, wherein said plane is parallel to said planar surface and a closed position, wherein said plane is substantially perpendicular to said planar surface;

b) a binder permanently attached to one of said covers and extending parallel to said hinge and wherein said binder is located closer to said centerline than to either of said first or second side edge;

c) a hold down page carried by said binder; and d) a hook and loop fastener hold down page latch arrangement that releasably secures said hold down page to a perimeter of one of said covers while being adjustable to accommodate varying degrees of binder storage volume.

19. A binder arrangement comprising:

a) a pair of covers each connected to a single spine by a hinge, each of said pair of covers pivotable about said single spine into an opposed orientation and hingably carried a predetermined distance from a centerline of said spine, wherein said centerline is located at the midpoint between a first and second side edge, and wherein said pair of covers and spine are defined by a board that includes a pair of spaced apart integrally formed hinges with each hinge being comprised of a plurality of pairs of scores formed in an interior surface of said board, wherein each score comprises a slit formed in the interior surface of said board that does not extend completely through said board, and wherein said scores of each hinge define a region of said board that is compressed to a thickness that is less than the surrounding thickness of said board;

b) a binder permanently attached to one of said covers and wherein said binder is located closer to said centerline than to either of said first or second side edge;

c) a case that includes a sidewall that extends between side edges of said covers that is releasably secured in a closed position by a zipper; and d) a stretchable gather with a strain relief characteristics configured to allow extension or enlargement beyond the limits of the strain relief characteristics of adjacent parts thereof, to dampen the pulling stress of said zipper in an open position, said gather attaches one end of said zipper to said spine.

20. A binder arrangement comprising:

a) a pair of covers hingably carried by a single spine, each of said pair of covers pivotable about said single spine into an opposed orientation and hingably carried a predetermined distance from a centerline of said spine, wherein said centerline is located at the midpoint between a first and second side edge, wherein said pair of covers and spine are defined by a board that includes a pair of spaced apart integrally formed hinges with each hinge being comprised of a plurality of pairs of scores formed in an interior surface of said board, wherein each score comprises a slit formed in the interior surface of said board that does not extend completely through said board, and wherein said scores of each hinge define a region of said board that is compressed to a thickness that is less than the surrounding thickness of said board;

b) at least one binder permanently attached to one of said covers and wherein said at least one binder is located closer to said centerline than to either of said first or second side edge;

c) a plurality of flexible sidewalls releasably joined by a zipper that has its zipper end stop resiliently anchored to said spine by an elastomeric connector having a strain relief characteristics that resumes its original shape when a deforming force is removed in contrast to the strain relief characteristics of adjacent parts thereof, to dampen the pulling stress of said zipper.

21. The case of claim 20 wherein said elastomeric connector comprises a piece of elastic fabric.

22. The binder arrangement according to claim 1, wherein each of said binders includes a plurality of fastening mechanisms, said binders are fixed substantially hermaphroditical with respect to each other, and each said fastening mechanism on said binders is provided in a staggered position with relation to the opposite said fastening mechanism such that said fastening mechanism do not overlie each other when the binder arrangement is disposed in said closed position.

23. The binder arrangement according to claim 22, wherein said fastening mechanism includes a paper straightening structure when the binder arrangement is in said closed position.

24. The binder arrangement according to claim 23, wherein said paper straightening structure is a linear portion of a D-shape ring.

* * * * *